United States Patent [19]

Lamort

[11] 4,447,320

[45] May 8, 1984

[54] DEVICE FOR CLEANING AND RECOVERING PAPER PULP

[75] Inventor: Jean-Pierre J. Lamort, Saint Lumier en Champagne, France

[73] Assignee: E et M Lamort, Vitry le Francois, France

[21] Appl. No.: 341,247

[22] Filed: Jan. 21, 1982

Related U.S. Application Data

[63] Continuation-in-part of Ser. No. 162,647, Jun. 24, 1980.

[30] Foreign Application Priority Data

Jan. 23, 1981 [FR] France ..... 81 01236

[51] Int. Cl.[3] ..... B07B 1/20

[52] U.S. Cl. ..... 209/273; 209/397; 209/300; 209/250

[58] Field of Search ..... 209/273, 250, 300, 305, 209/306, 397

[56] References Cited

U.S. PATENT DOCUMENTS

| | | | |
|---|---|---|---|
| 3,255,883 | 6/1966 | Nelson et al. | 209/273 X |
| 3,394,809 | 7/1968 | Hunter | 209/273 |
| 3,420,373 | 1/1969 | Hunter | 209/273 |
| 3,437,204 | 4/1969 | Clarke-Pounder | 209/273 |
| 3,647,067 | 3/1972 | Vogel | 209/273 X |
| 3,898,157 | 8/1975 | Hooper | 209/273 X |
| 4,200,537 | 4/1980 | Lamort | 209/273 X |

*Primary Examiner*—Kathleen J. Prunner
*Assistant Examiner*—William Bond
*Attorney, Agent, or Firm*—Darby & Darby

[57] ABSTRACT

A device for cleaning and recovering paper pulp includes a tank divided into inner and outer chambers by a fixed cylindrical sieve. The inner chamber also contains a rotating drum with blades that draw acceptable pulp from the outer chamber through the sieve to the inner chamber for discharge and moves rejected material through a helical path in the outer chamber toward another discharge point. The end of the helical path is blocked to form a dead space where the rejected material is concentrated and then periodically discharged.

6 Claims, 4 Drawing Figures

DEVICE FOR CLEANING AND RECOVERING PAPER PULP

This application is a continuation in part of application Ser. No. 162,647 filed June 24, 1980,

BACKGROUND OF THE INVENTION

In the paper industry, one currently carries out the recovery of old papers in the following manner:

The old papers are first dispersed in water and reduced into pulp in apparatus called pulpers operating a rough cleaning by elimination of the heavy parts of density higher than that of the pulp (a density of about 1.027).

The pulpers operate in general at a low concentration, less than 5%.

At the outlet of the pulper, the pulp is sent in at least one screen or strainer, operating a screening with a sieve. The object of this operation is to clear the pulp from the wood, plastics and metal contaminants it may contain. Generally, a series of two apparatus has to be used, one of them comprising at least one fine slit sieve which eliminates all the elements having a particle size exceeding the width of the slits, while letting through the fibres and the flat and very thin elements; the other apparatus comprises at least one hollowed sieve eliminating the flat elements.

It is usual to operate with an apparatus comprising a sieve with holes having a diameter of the order of 4 to 5 mm, followed by an apparatus comprising a sieve having slits of a width of the order of 0.3 to 0.4 mm.

At the outlet of these apparatus, called screens or strainers, and which will be for example of the type discussed in French Pat. No. 77.35151 filed on the Nov. 23, 1977, a cleaned pulp containing water and fibres with the exclusion of contaminants is obtained on one side, and refusals or rejections with a high content of contaminants is obtained at the other side.

By way of example and with an apparatus such as that discussed in French Pat. No. 77.35151 into which is sent a pulp having a concentration of the order of 3 to 5% of dry materials and containing about 5% of pollutants, there is obtained at the outlet:

- on the one hand a pulp containing 0.05% of pollutants with a concentration which is always of the order of 3 to 5% of dry materials:
- on the other hand a rejection containing about 30% to 50% of pollutants, the remainder being pulp with a concentration of the order 3 to 5% of dry materials.

One sees that the rejections contain appreciable quantites of pulp and that they are highly diluted. Thus, said rejections cannot be discarded and they are very cumbersome.

The presently most prevalent process for treating them consists in sending them into auxiliary apparatus usually called "sorters" which are generally vibrating sieves in which the rejections are washed in a high diluted state and in an open field thereby allowing obtaining on the one hand washed rejections and on the other hand a very diluted pulp intented for being recycled.

Such apparatus are affected with serious disadvantages, first of all because, by operating in an open field, they require a pumping system and a supply of clean water; they are therefore consumers of energy and water and produce very diluted products which have to be thereafter reconcentrated; on the other hand, as all vibrating apparatus, they require large masses of support concrete for absorbing the vibrations, and their maintenance costs are high; finally, if the cleaning has been carried out by means of fine slit sieves, the washing of the rejections is practically inoperative since a vibrating sieve is necessarily a hollowed sieve, the slit sieves not offering a sufficient mechanical strength for equipping vibrating apparatus. Due to this fact, a large part of the rejections eliminated by the strainer get through the vibrating sieve and are recycled.

OBJECTS AND SUMMARY OF THE INVENTION

The object of the present invention is a sorter device capable of continuously cleaning a paper pulp by supplying washed refusals containing no more than 10% of paper pulp.

The device which is the object of the invention is characterized in that it comprises a closed tank provided with a pulp inlet and a cleaned pulp outlet, said tank containing a fixed sieve separating two chambers, an inner chamber and an outer chamber, and an inner rotor carrying blades or vanes moving in the vicinity of the sieve; the outer chamber, encompassed between the sieve and the tank wall, being provided with a helical wall and having thus the shape of a helical channel which is wrapped around the sieve from the pulp inlet to a refusals dead end situated at two opposite ends of said outer chamber, the said dead end comprising a gate to extract the refusals from time to time.

The invention aims also at the following dispositions:

- there is foreseen an additional water inlet in the inner chamber, on the side of the pulp arrival,
- the helical outer chamber is placed such that it is wrapped around the fixed sieve from the pulp inlet to the refusals outlet, with a rotation direction consistent with that of the liquid in said outer chamber,
- this rotation direction is the direction contrary to that of the rotor rotation direction.

In a preferred embodiment of the invention the pulp inlet and the cleaned pulp outlet are on the same side of the apparatus and the dead end as well as the additional water inlet are on the opposite side of the apparatus.

BRIEF DESCRIPTION OF THE DRAWINGS

The invention will become more apparent from the following description which is made with reference with the accompanying drawing wherein.

Figure 1:
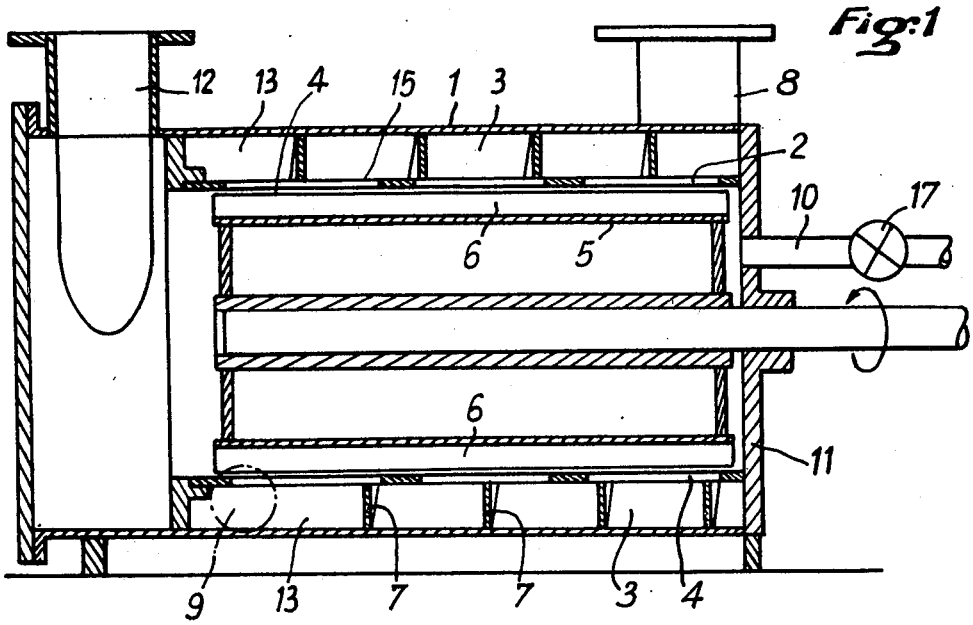
FIG. 1 is an axial sectional schematic view of a device according to the invention.

Reference being made to said figures, one sees that the device according to the invention is of the type comprising a closed tank 1 in which a fixed cylindrical sieve 2 separates two chambers 3 and 4, a rotor or rotating drum 5 being foreseen inside the inner chamber 4, said drum being provided with longitudinal blades 6. Such a device is discussed in French Pat. No. 77.35151 filed on Nov. 23, 1977 in the name of the Applicant.

According to the present invention, the outer chamber 3, encompassed between the sieve 2 and the wall of the closed tank 1, is partitioned by a helical wall 7. Thus, the chamber 3 has the shape of a helical chamber extending from the pulp inlet 8 to the rejections or refusals outlet 9; the inlet 8 and the outlet 9 are located at the opposite ends of the helical chamber 3.

A water inlet 10 is foreseen in the inner chamber 4, on the wall 11 which is opposite the outlet 12.

The operation of the device is the following: the pulp to be cleaned reaches the apparatus at 8. As it proceeds inside chamber 3, it is cleaned: the fibres get through the sieve 2 and the pulp which is deprived of its impurities comes out at 12. The refusals progress slowly along chamber 3 and are concentrated gradually until they reach the dead end space 13 which is immediately upstream of gate 14 normally closed, where they are retained as long as the gate 14 is closed. By periodically opening the gate 14, refusals completely washed and concentrated to a mass or kind of stopper may be removed, while the pulp is entirely recovered at 12.

One sees that the washing of the refusals is thus carried out in a closed apparatus, that is under pressure, thereby avoiding all the disadvantages of open apparatus, particularly as regards the pulp and refusals circulation means. On the other hand, it is an apparatus operating continuously as regards the inlet and outlet of the pulp, the outlet of the refusals alone being carried out discontinuously.

These results had never been reached hitherto, since with an apparatus closed and operating continuously and under pressure, one could only separate a cleaned pulp from a pulp containing a concentration of pollutants, but without being able to wash away the pollutants.

Moreover, the apparatus of the invention comprises the following preferential dispositions:

The helical wall 7 forms a spiral extending from the inlet 8 to the outlet 9 by following the direction of rotation of the pulp in chamber 3.

As a matter of fact, the pulp which reaches chamber 3 moves within said chamber by effecting a rotating movement around the sieve; said rotating movement is caused by the rotation of the drum 5 in combination with the shape of the sieve perforations and the disposition of inlet 8 which is for example tangential.

Figure 3:
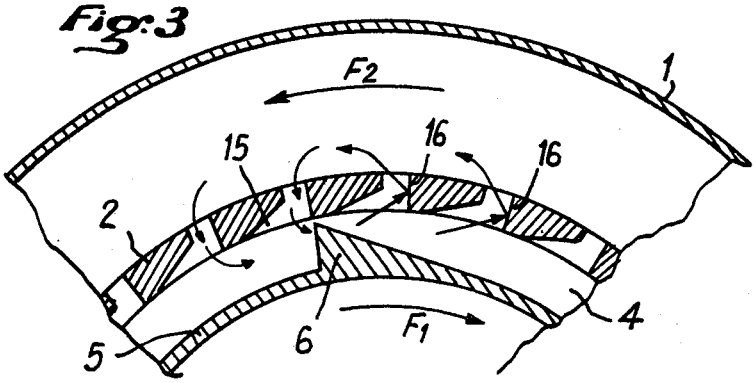
FIG. 3 is a detailed sectional view, perpendicular to the rotor axis, showing the preferred embodiment of the blades and the perforations.

Particularly, if the holes or slits which are forming the perforations 15 of the sieve 2, have in cross-section the shape shown in FIG. 3, that is to say a form splayed towards the chamber 4 and dissymetrical, with a radial wall 16 opposite to the direction of flow, the rotation of the drum 5 in the direction of arrow F1 causes a rotation of the pulp inside chamber 3 along arrow F2 due to the reflection of the streams of liquid on the radial walls 16 of the perforations 15.

Figure 2:
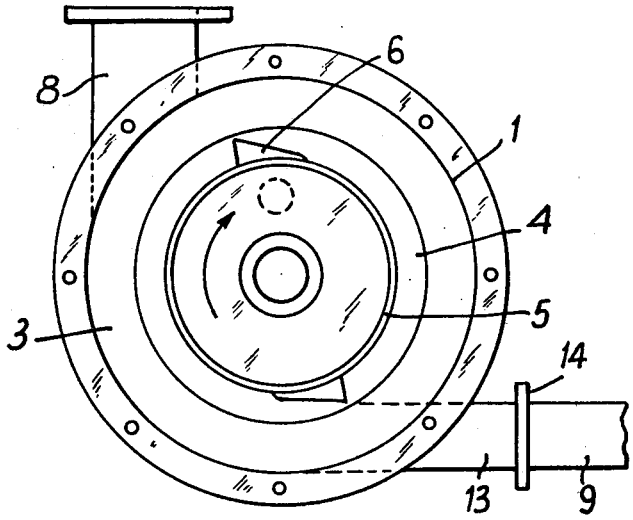
FIG. 2 is an end view of the same device with the end plate removed.

In this case and according to the invention, the wall 7 is wrapped around the sieve 2 so to extend from the inlet 8 to the outlet 9 by turning around the sieve 2 in the direction contrary to the rotation direction of the drum 5; and as is shown in FIG. 2, the inlet 8 and the outlet 9 are placed tangentially to tank 1 for corresponding to a rotation of the liquid in a reverse direction to the rotation direction F1 of drum 5.

The pitch of the helix formed by wall 7 will be preferably larger than the diameter of inlet 8.

A water inlet is provided at 10. This auxiliary water supply allows obtaining a better washing of the refusals. This water inlet is controlled by a gate 17 and the additional water flow rate is preferably less than 20% of the pulp flow rate arriving at 8. Thus, the pulp is not highly diluted and may be re-cycled as it stands from the outlet 12.

Figure 4:
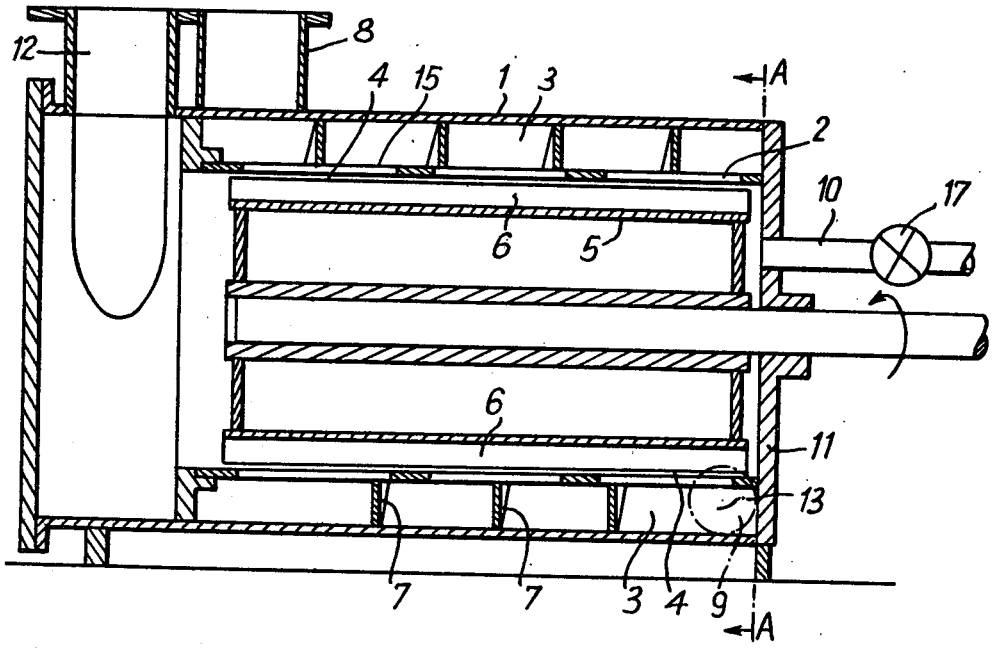
FIG. 4 is a view similar to FIG. 1 of a preferred embodiment of the invention.

According to FIG. 4 the pulp inlet 8 is placed close to the cleaned pulp outlet 12, on the same side of the apparatus, and the dead end 13-9 of helical chamber 3 is placed on the opposite side of the apparatus near the wall 11 in which water inlet 10 is provided.

By that disposition the washing of the refusals is considerably improved because the action of blades 6 near the wall 11 is exerted on dilution water almost deprived of pulp and therefore the final washing, at the end of chamber 3, is made with practically pure water.

The improvement in washing given through the embodiment of FIG. 4 is such that the amount of good pulp which is rejected with the refusals falls down to about 1%; this is a prominent advantage, if one keeps in mind that such apparatusses work continuously, provoking a progressive accumulation of refusals reaching a large amount of tons.

The apparatus according to the invention may be used in different ways. It may be associated with a strainer the refusals of which have to be washed with a view to recovering the pulp which said refusals contain. Such a strainer can be according to the aforementioned French Pat. No. 77.35151.

But the apparatus according to the invention may also be used directly as an improved strainer in which is sent the pulp prepared in the pulper; however, experience shows that the latter solution provides results which are not as good since the optimum dimensional characteristics of a given pulp are not the same at the various cleaning stages. Therefore, it is often preferable to use in succession a hollowed strainer followed by a slit cleaner and then by a slit sorter according to the present invention.

With such a succession of equipment, one may foresee a sorter having a drum of diameter slightly less than that of the strainer as such, thereby allowing carrying out the washing of the refusals with an economically acceptable consumption of energy.

It is thus possible to exclude the rejections which contain little or no pulp from the rejections of the preceding strainer which contained from 30 to 50% of pollutants in a pulp having a dry material content of the order of 3 to 5%.

What is claimed is:

1. A cleaning and recovery device for paper pulp comprising:

a closed tank with first and second end walls, said tank being chargeable with contaminated pulp material to be washed;

a fixed cylindrical sieve (2) with perforations located within and separating the tank into inner and outer chambers (3 and 4);

a rotor (5) drum situated within the inner chamber and provided with longitudinal blades or vanes (6) moving within and extending to the vicinity of the sieve along substantially its entire effective length, the perforations of said sieve having a form splayed towards the inner chamber and dissymetrical, the perforations having a radial wall at the remote edge of the perforation in the direction of rotation of the blades or vanes, said blade having a sloped surface facing in its direction of rotation, the sloped surface directing the material moving with the blades or vanes in the inner chamber against the radial walls of the perforations such that the material in the outer chamber moves in a direction opposite to the movement of the blades or vanes;

a helical wall located in the outer chamber (3) between the sieve (2) and the tank (1) so as to provide said outer chamber (3) with the shape of a helical channel which is wrapped around the sieve along its length;

a pulp inlet (8) at one end of the helical channel and a refusals outlet (9) at the other end;

a cleaned pulp outlet (12) at the first end wall of said inner chamber (4); and closing-off means (14) for stopping the flow of material through said helical channel to retain the refusals at a dead end of the inner chamber upstream thereof for selected time intervals so as to concentrate the refusals material and periodically discharge it, said rotor blades generating substantially uniform and continuous washing turbulence across the sieve between said pulp inlet and said refusals outlet, which turbulence draws acceptable pulp material across the sieve to the inner chamber and moves the remainder in the helical channel towards the refusals outlet.

2. A device according to claim 1, characterized in that it comprises a water inlet (10) directing water into the inner chamber (4) from the second end wall (11) which is opposite the cleaned pulp outlet (12), at the first end wall.

3. A device according to claim 2, wherein the water inlet includes means for adjusting the water flow rate through the water inlet to less than 20% of the flow rate of the pulp to be cleaned.

4. A device according to any of claims 2 or 3 wherein the pulp inlet (8) is placed in the vicinty of the cleaned pulp outlet (12) opposite to the second end wall (11), and the dead end (9) of helical chamber (3) is placed close to the first end wall (11) through which emerges the water inlet (10).

5. A device according to claim 1, wherein the helical wall (7) is wrapped around the sieve (2) from the pulp inlet (8) to the refusals outlet (9) with a rotation direction for materials therein which is contrary to that of the rotor (5).

6. The device of claim 1 in which said closing-off means comprises a controllable gate in the flow path of material in said channel adjacent said refusals outlet.

* * * * *